US005305667A

United States Patent [19]

Caballero

[11] Patent Number: 5,305,667

[45] Date of Patent: Apr. 26, 1994

[54] ADJUSTABLE WRENCH

[76] Inventor: Juan Caballero, P.O. Box 162, Morgan Hill, Calif. 95038

[21] Appl. No.: 44,706

[22] Filed: Apr. 12, 1993

[51] Int. Cl.[5] ..... B25B 13/16

[52] U.S. Cl. ..... 81/165; 7/138; 7/165; 81/437; 81/439; 81/490; 81/177.4; 81/186

[58] Field of Search ..... 7/138, 165; 81/165, 81/186, 437, 439, 490, 177.4

[56] References Cited

U.S. PATENT DOCUMENTS

| | | | |
|---|---|---|---|
| 366,439 | 7/1887 | Troy | 81/437 X |
| 1,490,903 | 4/1924 | Anderson | 81/165 X |
| 1,511,395 | 10/1924 | Canan | 81/165 X |

FOREIGN PATENT DOCUMENTS

| | | | |
|---|---|---|---|
| 497127 | 3/1919 | France | 81/437 |

*Primary Examiner*—James G. Smith
*Attorney, Agent, or Firm*—Leon Gilden

[57] ABSTRACT

A wrench structure including a wrench head having a fixed jaw, with a movable jaw arranged in a sliding confronting relationship relative to the fixed jaw is arranged, wherein the fixed and movable jaws each include mirror image confronting faces, with each face having a mirror image V-shaped recess to accommodate enhanced securement of a wrench flat complementary surface portion of an associated workpiece for grasping within the V-shaped recesses.

2 Claims, 4 Drawing Sheets

ADJUSTABLE WRENCH

BACKGROUND OF THE INVENTION

1. Field of the Invention

The field of invention relates to adjustable wrench structure, and more particularly pertains to a new and improved adjustable wrench wherein the same is arranged to include confronting V-shaped recesses to enhance securement of a workpiece therebetween.

2. Description of the Prior Art

Adjustable wrenches of various types are utilized throughout the prior art, wherein U.S. Pat. No. 3,968,708 to Ingersoll sets forth an adjustable wrench having a movable jaw directed in a reciprocating relationship relative to a fixed jaw.

Further examples of wrench structure are set forth in the U.S. Pat. Nos. 4,967,613; 4,028,970; and 5,048,380.

The instant invention attempts to overcome deficiencies of the prior art by providing for the parallel facing wrench flats having confronting and facing V-shaped recesses to enhance securement of a workpiece therebetween and in this respect, the present invention substantially fulfills this need.

SUMMARY OF THE INVENTION

In view of the foregoing disadvantages inherent in the known types of adjustable wrench structure now present in the prior art, the present invention provides an adjustable wrench having confronting and facing V-shaped recesses for securement of a workpiece. As such, the general purpose of the present invention, which will be described subsequently in greater detail, is to provide a new and improved adjustable wrench which has all the advantages of the prior art adjustable wrench and none of the disadvantages.

To attain this, the present invention provides a wrench structure including a wrench head having a fixed jaw, with a movable jaw arranged in a sliding confronting relationship relative to the fixed jaw, wherein the fixed and movable jaws each include mirror image confronting faces, with each face having a mirror image V-shaped recess to accommodate enhanced securement of a wrench flat complementary surface portion of an associated workpiece for grasping within the V-shaped recesses.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying /ut the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable wrench which has all the advantages of the prior art adjustable wrenches and none of the disadvantages.

It is another object of the present invention to provide a new and improved adjustable wrench which may be easily and efficiently manufactured and marketed.

It is a further object of the present invention to provide a new and improved adjustable wrench which is of a durable and reliable construction.

An even further object of the present invention is to provide a new and improved adjustable wrench which is susceptible of a low cost of manufacture with regard to both materials and labor, and which accordingly is then susceptible of low prices of sale to the consuming public, thereby making such adjustable wrenches economically available to the buying public.

Still yet another object of the present invention is to provide a new and improved adjustable wrench which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
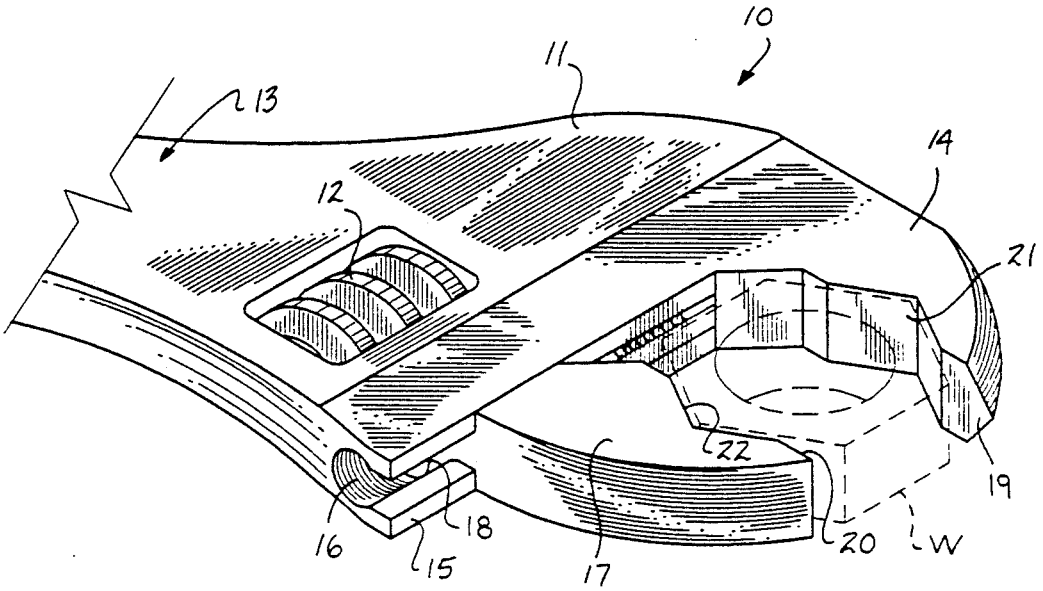
FIG. 1 is an isometric illustration of the wrench structure of the invention.

With reference now to the drawings, and in particular to FIGS. 1 to 8 thereof, a new and improved adjustable wrench embodying the principles and concepts of the present invention and generally designated by the reference numeral 10 will be described.

More specifically, the adjustable wrench 10 of the instant invention essentially comprises a wrench head 11, having a drive worm screw 12, with a wrench handle 13 extending from the wrench head 11. The wrench head 11 includes a fixed jaw 14 arranged in a facing relationship relative to a movable jaw 17, wherein a wrench head end wall 15 of the wrench head 11 includes an end wall guide slot 16 intersecting the fixed jaw 14 and slidably receiving the movable jaw 17 therealong, with the movable jaw 17 having a follower 18 received within the slot 16 and operative through the drive worm screw 12, in a manner as indicated in U.S. Pat. No. 3,968,708 incorporated herein by reference.

Figure 2:
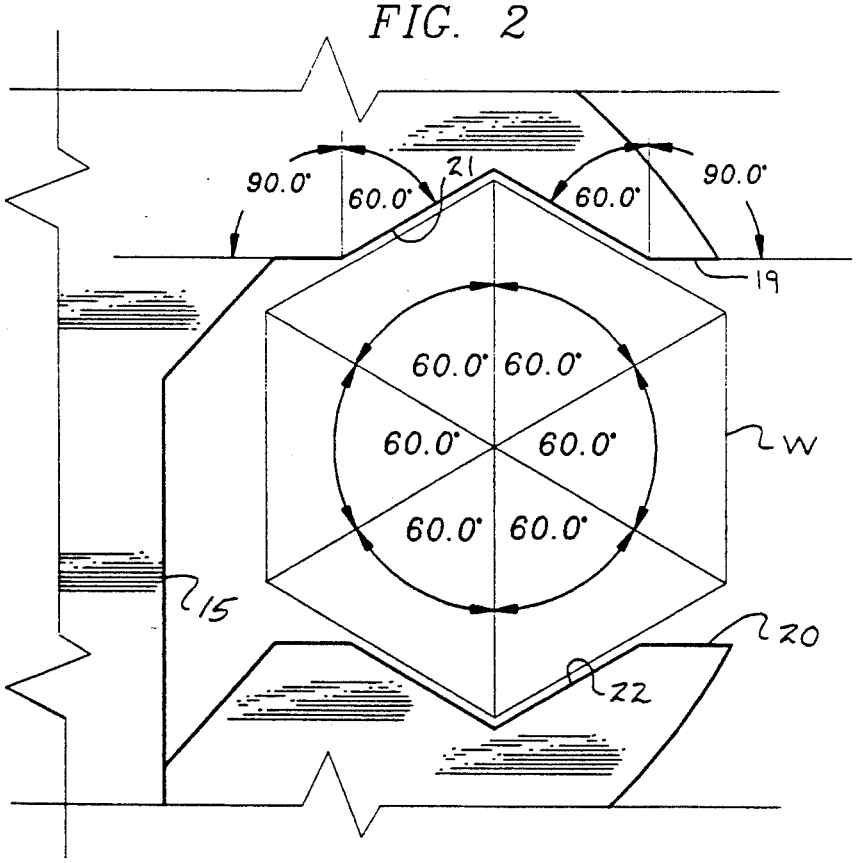
FIG. 2 is an orthographic view of the wrench faces in a facing relationship securing a workpiece therebetween.

A fixed jaw wall 19 is arranged in a parallel and coextensive relationship relative to a movable jaw wall 20, wherein the fixed and movable jaw walls 19 and 20 are orthogonally oriented relative to the wrench head end wall 15. A first V-shaped recess 21 is directed into the fixed jaw wall 19, while a second V-shaped recess 22 is directed into the movable jaw wall 20 such that the first and second V-shaped recesses 21 and 22 respectively are arranged in a mirror image facing relationship relative to one another, as indicated in FIGS. 1 and 2, to secure a workpiece "W" therebetween. Typically such workpieces by way of example are of hexagonal configuration, having sixty degree separation between adjacent apices of the &lats and accordingly, the first and second V-shaped recesses are configured to complementarily receive such an apex but it is understood, that the recesses 21 and 22 may be of varied configurations as required.

Figure 3:
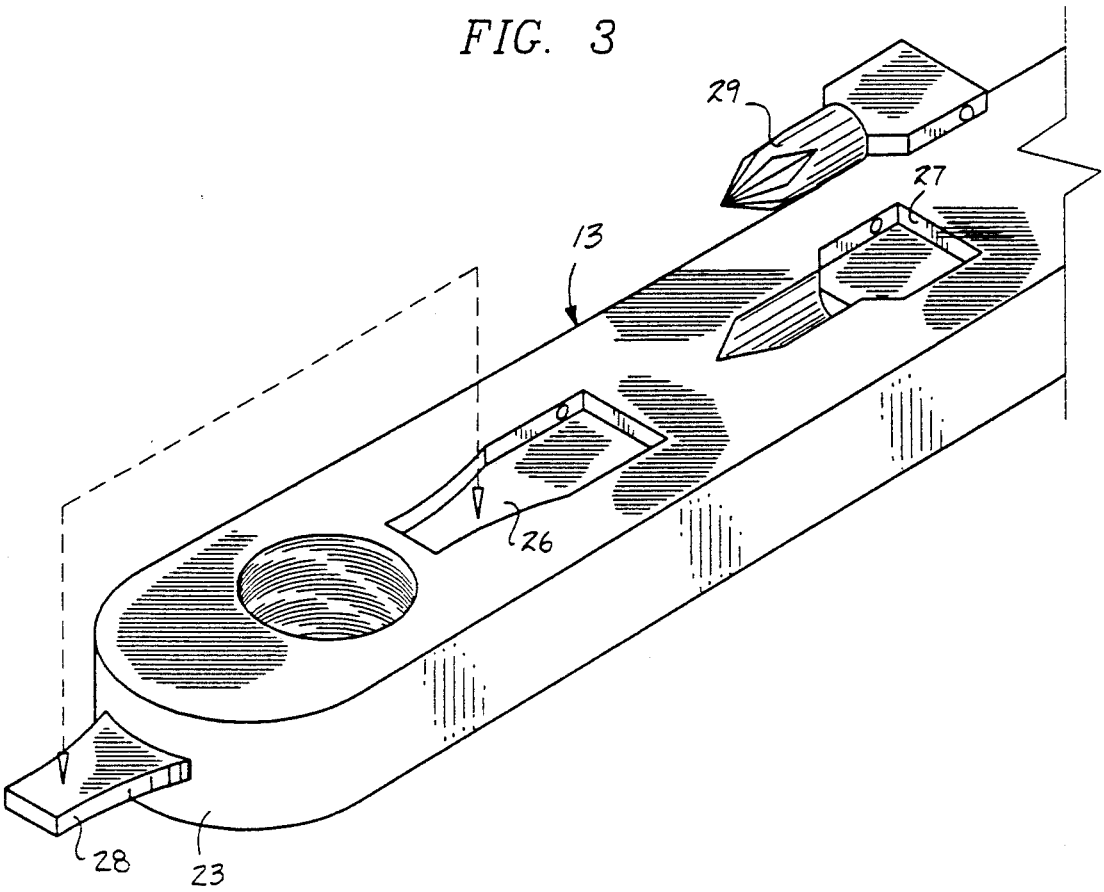
FIG. 3 is an isometric illustration of the handle structure of the invention.
Figure 4:
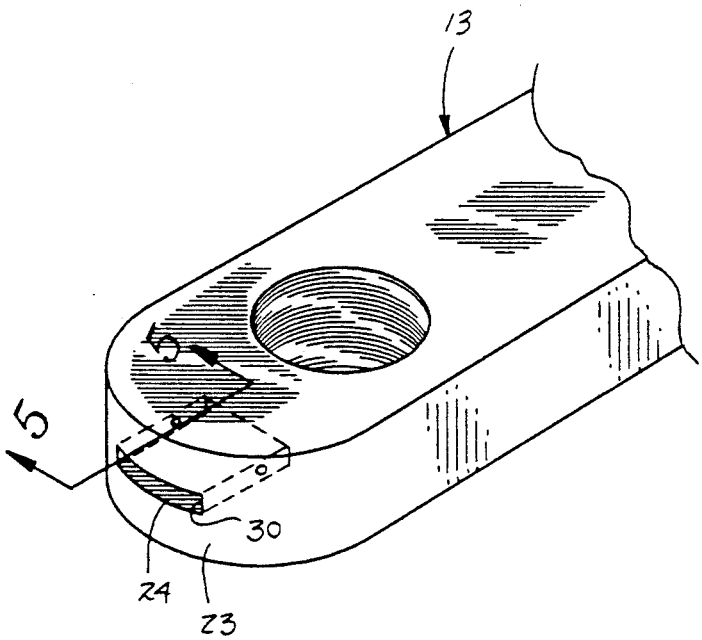
FIG. 4 is an isometric illustration of the invention indicating the screwdriver head receiving cavity therewithin.
Figure 5:
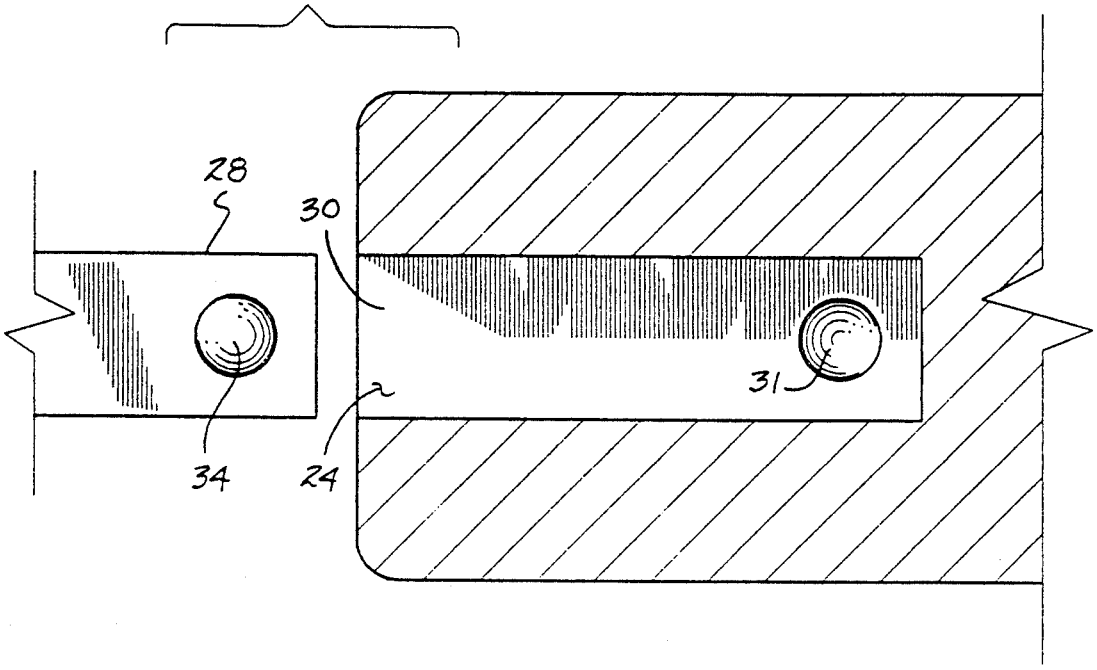
FIG. 5 is an orthographic cross-sectional illustration of the screwdriver head receiving cavity.
Figure 6:
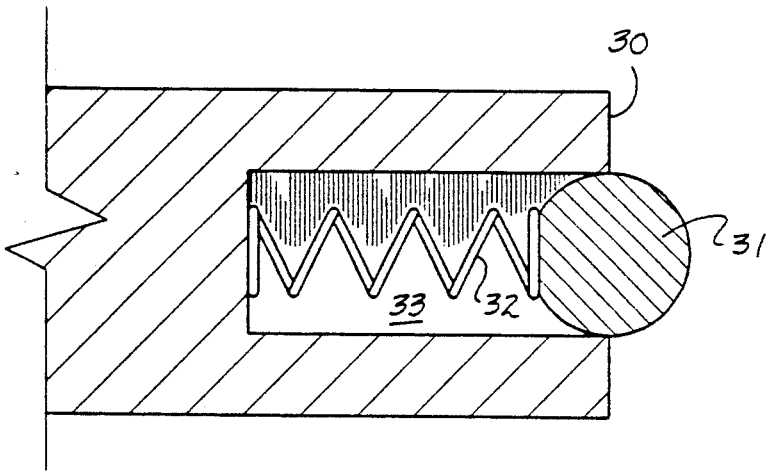
FIG. 6 is an enlarged orthographic side view of the screwdriver receiving cavity side wall and associated spherical detent structure.

In the FIGS. 3 and 4, the handle 13 includes a handle end wall 23 including a polygonal cavity 24 directed therein, with the polygonal cavity including spaced parallel cavity side walls 30. The FIGS. 5 and 6 indicates that the polygonal cavity 24 is configured such that the cavity side walls 30 each include a respective detent sphere 31 biased into the cavity 24 from a detent sphere cavity 33, with the detent sphere 31 arranged for reception within screwdriver head semi-spherical recesses 34 of respective first and second screwdriver blade members 28 and 29 that in turn are arranged for complementary reception within respective first and second recesses 26 and 27 mounted into the handle top wall, as indicated in FIG. 3. In this manner, the screwdrivers are arranged for reception within the end wall 23 permitting optional employment of the organization as a screwdriver, wherein typically, the handles are of ferrous material and the screwdriver blade members 28 and 29 are of a ferromagnetic material for adherence and securement within the recesses 26 and 27 during periods of non-use and storage.

Figure 7:
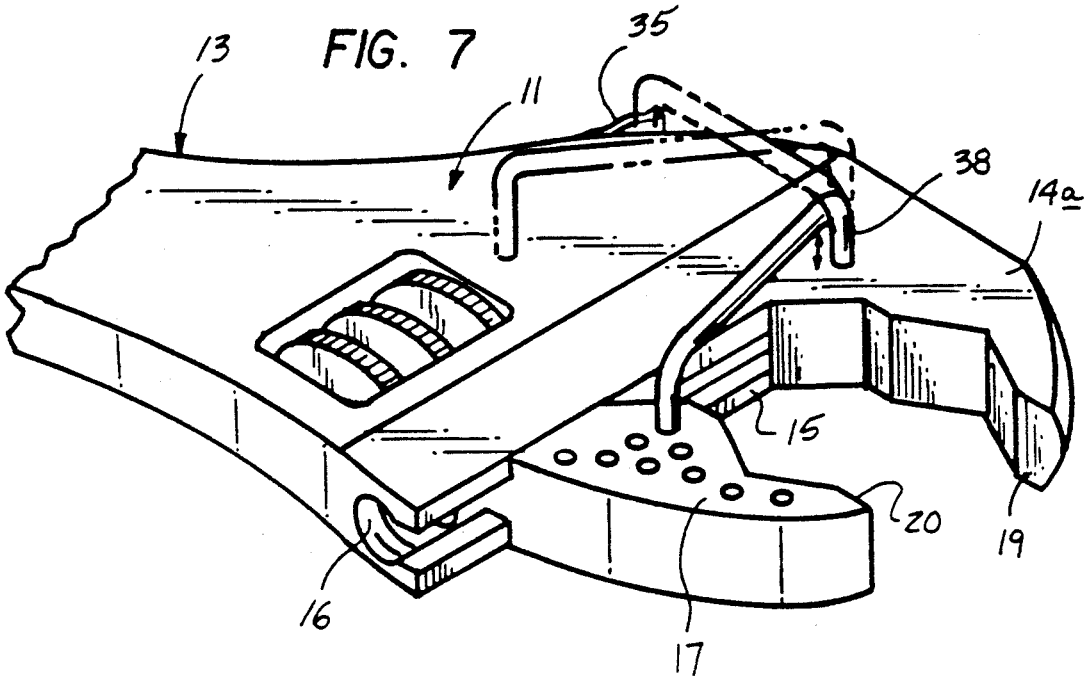
FIG. 7 is an isometric illustration of a modified wrench head structure.
Figure 8:
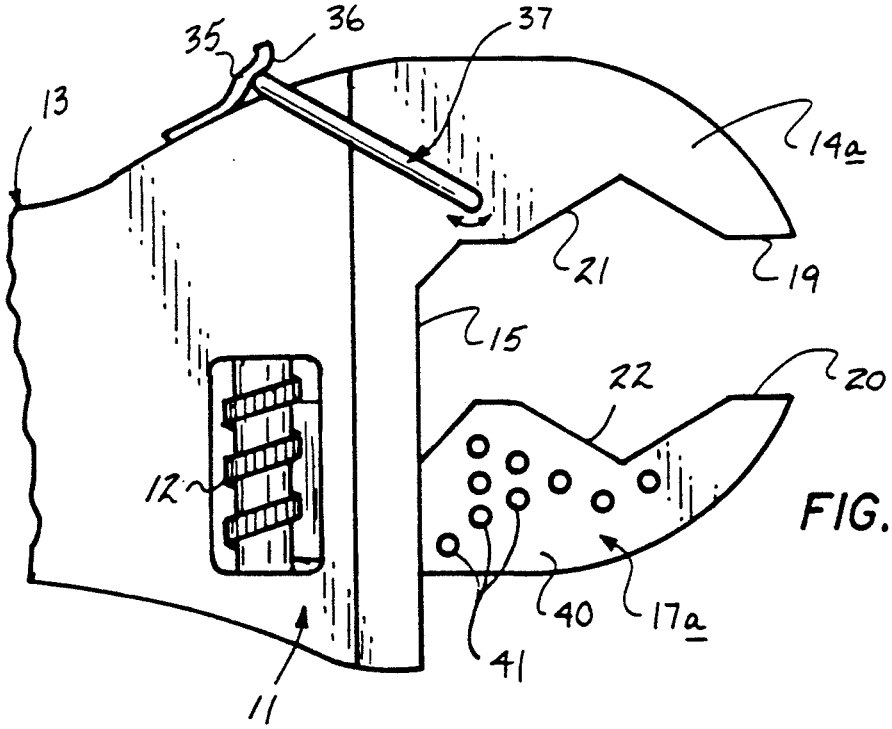
FIG. 8 is an orthographic top view of the modified wrench head structure.

The FIGS. 7 and 8 includes a modified head structure 11*a*, having modified fixed movable jaws 14*a* and 17*a* respectively. The cooperation and relationship of the modified jaws 14*a* and 17*a* are as described above, but wherein a U-shaped lock bar 37 having a first leg 38 arranged in a parallel relationship relative to a second leg 39 is provided, such that the first leg 38 is orthogonally, rotatably, and slidably received within the fixed jaw side wall, with the second leg 39 arranged for selective reception within a latch recess 36 defined by a spring plate 35 mounted to the modified head 11*a* to secure the second leg 39 in a biased frictional engagement during periods of non-use and for assisting in locking of the movable jaw relative to the fixed jaw, a matrix of side wall bores 41 parallel to the first leg 38, as well as the second leg 39 are directed into the movable jaw side wall 40 to permit mechanical latching of the movable jaw relative to the fixed jaw preventing displacement of the movable jaw along the wrench head end wall 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable wrench, comprising, a wrench head, the wrench head having a drive worm screw rotatably mounted within the wrench head, with the wrench head including a wrench head end wall, and a fixed jaw fixedly mounted to the wrench head, with the fixed jaw including a fixed jaw wall orthogonally oriented relative to the wrench head end wall, and a guide slot directed into the wrench head in communication with the wrench head end wall, and a movable jaw having a follower, with the follower received within the guide slot, and the movable jaw further including a movable jaw wall arranged in a parallel coextensive relationship relative to the fixed jaw wall, and a first V-shaped recess directed into the fixed jaw wall, and a second V-shaped recess directed into the movable jaw wall, wherein the &irst V-shaped recess and the second V-shaped recess are arranged in a mirror image facing relationship relative to one another, and the drive worm screw is arranged for reciprocation of the movable jaw within the guide slot, and further including an elongate wrench handle integrally mounted relative to the wrench head, with the wrench handle having a handle end wall, the handle end wall including a polygonal cavity directed into the handle end wall, the polygonal cavity having spaced cavity side walls, and the handle having a handle top wall, and at least one recess, the at least one recess directed into the handle top wall, with the wrench handle formed of a ferrous metallic material, and a screwdriver blade member complementarily received 7ithin the recess, the screwdriver blade member formed of a magnetic material, and the blade member having a blade member head, and the blade member head having at least one semi-spherical recess directed therein, and at least one of said cavity side walls having a detent cavity directed into the at least one cavity side wall, with the detent cavity having a cavity spring and a detent sphere mounted to the cavity spring, wherein the detent sphere is directed into the polygonal cavity from the detent cavity for reception within the semi-spherical recess for selective securement of the screwdriver blade member within the polygonal cavity.

2. An adjustable wrench as set forth in claim 1 wherein the wrench head includes a spring plate defining a latch recess between the spring plate and the wrench head, and a U-shaped lock bar having a first leg and a second leg, wherein the first leg is orthogonally and reciprocatably directed into the fixed jaw spaced from the fixed jaw wall, and the first leg rotatably mounted within the fixed jaw permitting reception of the second leg within the latch recess, and the movable jaw having a movable jaw side wall, and the movable jaw side wall including a matrix of side wall bores oriented parallel to the first leg and the second leg for selective reception of the second leg within one of said side wall bores for fixed securement of the fixed jaw relative to the movable jaw.

* * * * *